US005592920A

United States Patent [19]

Fehlmann

[11] Patent Number: 5,592,920

[45] Date of Patent: Jan. 14, 1997

[54] DISTRIBUTOR-TYPE FUEL INJECTION PUMP FOR INTERNAL COMBUSTION ENGINES

[75] Inventor: Wolfgang Fehlmann, Stuttgart, Germany

[73] Assignee: Robert Bosch GmbH, Stuttgart, Germany

[21] Appl. No.: 464,896

[22] PCT Filed: Oct. 28, 1994

[86] PCT No.: PCT/DE94/01267

§ 371 Date: Jun. 29, 1995

§ 102(e) Date: Jun. 29, 1995

[87] PCT Pub. No.: WO95/13469

PCT Pub. Date: May 18, 1995

[30] Foreign Application Priority Data

Nov. 10, 1993 [DE] Germany ..... 43 38 344.0

[51] Int. Cl.[6] ..... F02M 41/00

[52] U.S. Cl. ..... 123/450; 417/402

[58] Field of Search ..... 123/450, 299, 123/300, 179, 17, 504; 417/402

[56] References Cited

U.S. PATENT DOCUMENTS

| | | | |
|---|---|---|---|
| 4,531,491 | 7/1985 | Iiyama | 123/450 |
| 4,575,316 | 3/1986 | Mowbray | 123/450 |
| 4,604,980 | 8/1986 | LeBlanc | 123/450 |
| 4,840,162 | 6/1989 | Brunel | 123/450 |
| 4,889,096 | 12/1989 | Brunel | 123/450 |
| 5,044,898 | 9/1991 | Harris | 123/450 |
| 5,050,558 | 9/1991 | Brunel | 123/450 |
| 5,215,060 | 6/1993 | Flopfer | 123/450 |
| 5,443,048 | 8/1995 | Nicol | 123/450 |

FOREIGN PATENT DOCUMENTS

| | | | |
|---|---|---|---|
| 2437502 | 4/1980 | France | 123/450 |

*Primary Examiner*—Carl S. Miller

*Attorney, Agent, or Firm*—Edwin E. Greigg; Ronald E. Greigg

[57] ABSTRACT

A distributor-type fuel injection pump of the radial-plunger type with two intersecting cylinder bores in the rotor part, in each of which two pump plungers arranged opposite one another and delimiting a common pump working space are guided. The pump plungers guided in the first cylinder bore are here designed with an axial length such that, during their delivery stroke, they project into the second cylinder bore, the pump plungers of which do not reach the first cylinder bore even in the case of the maximum delivery stroke. According to the invention, the short pump plungers have a stop formed by a collar on their end projecting out of the cylinder bore, and this stop prevents the short pump plungers from slipping unintentionally in between the long pump plungers when the pump is switched off, thus allowing the delivery stroke of the pump plungers to be increased to an extent such that, during their suction stroke, the long pump plungers leave the cylinder bore guiding the short pump plungers.

3 Claims, 2 Drawing Sheets

DISTRIBUTOR-TYPE FUEL INJECTION PUMP FOR INTERNAL COMBUSTION ENGINES

PRIOR ART

The invention is directed to a distributor-type fuel injection pump for internal combustion engines. In a distributor-type fuel injection pump of this kind known from EP-B 0 382 388, a drive shaft drives a rotor which is guided in a casing and in which two pump-plunger pairs each guided in a cylinder bore are arranged in a plane radial relative to the drive shaft. The cylinder bores arranged in a common radial plane of the rotor here intersect at right angles and the individual pump plungers thus delimit with their radially inward-facing end faces a common pump working space in the overlapping region of the cylinder bores. The ends of the pump plungers, which project from the cylinder bores, run by means of a roller tappet along a fixed cam track of a cam ring guided in the casing, with the result that, during a rotary motion of the rotor, they have a reciprocating motion imparted to them, opening the connection of the cylinder bore to a filling line starting from a low-pressure space during the radially outward suction-stroke movement, which line is then closed by the pump plungers during the subsequent delivery stroke. The fuel compressed in the common pump working space during the delivery stroke then passes via a high-pressure passage in the rotor to a distributor hole which leads off radially from said passage and, during the rotary motion of the rotor, comes into overlap with the individual high-pressure delivery lines leading to the injection locations.

The pump-plunger pairs in the two cylinder bores are here designed in such a way that a longer plunger pair guided in a first cylinder bore projects with its pump working-space end into the second cylinder bore, and the shorter guided plunger pair does not reach the first cylinder bore even in its maximum delivery-stroke position.

However, the known distributor-type fuel injection pump has the disadvantage that the cam lift, which is the same for all the pump plungers, must be less than half the diameter of the cylinder bores, which are each made of equal size. This is necessary in this case to ensure that the long plungers still project into the second cylinder bore, even in their maximum suction-stroke position, in order reliably to prevent the shorter plungers from sliding by themselves between the long plungers when the internal combustion engine is switched off and the pump working space is unpressurized, since this otherwise leads to the mechanical destruction of the distributor-type injection pump during its operation. However, this imposes structural limits on the delivery stroke of the pump plungers, limiting the performance parameters of the entire pump.

ADVANTAGES OF THE INVENTION

In contrast, the distributor-type fuel injection pump according to the invention has the advantage that the shorter pump plungers can be reliably prevented from sliding unintentionally into the cylinder bore between the long pump plungers by means of a stop on their end projecting out of the cylinder bore.

This eliminates the need that the long pump plungers should project continuously into the cylinder bore guiding the short pump plungers, allowing the cam lift to be made greater than half the diameter of the cylinder bore to give a bigger delivery-stroke movement. This increase in the delivery stroke can advantageously be converted into an increase in the injection pressure or a larger delivery quantity.

The stop on the short pump plungers is advantageously arranged in such a way that it permits them to enter the cylinder bore guiding them until their pump working-space end approaches to within a short distance of the second cylinder bore and it is thus possible to achieve large delivery-stroke lengths.

The stop on the short pump plungers can be embodied in a simple manner by a collar or a retaining ring guided in an annular groove in the body of the short plungers, which then interact in a simple manner with the end wall of the cylinder bore.

Further advantages and advantageous developments of the subject-matter of the invention can be taken from the description, the drawing and the claims.

BRIEF DESCRIPTION OF THE DRAWING

Two exemplary embodiments of the distributor-type fuel injection pump according to the invention are depicted in the drawing and are explained in greater detail below.

DESCRIPTION OF THE EXEMPLARY EMBODIMENTS

Figure 1:
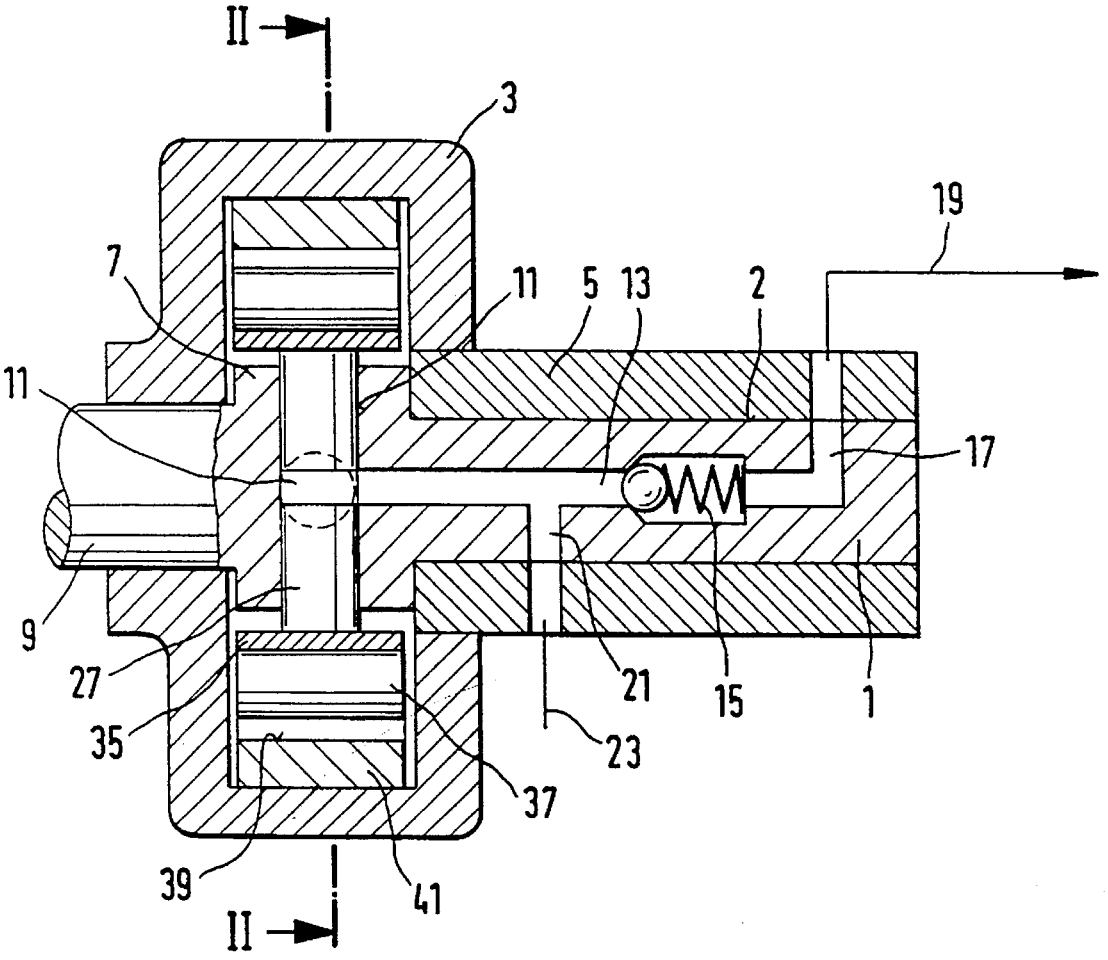
FIG. 1 shows a longitudinal section through that part of the distributor-type fuel injection pump which is essential to the invention.

In the distributor-type fuel injection pump depicted in simplified form in FIG. 1, a piston-shaped rotor part 1 is mounted in a manner which allows it to rotate about its axis in a cylinder bore 2 of a cylindrical guide part 5 connected firmly to the pump casing 3. At one end, the rotor part 1 has a part 7 of larger diameter which is connected firmly in terms of rotation to a drive shaft 9 driven in synchronism with the speed of the internal combustion engine and in which are arranged two through-holes 11 in a common plane extending radially to the axis of the rotor part 1, the said through-holes intersecting at right angles.

Leading off from these through-holes 11 on the axis of the rotor part 1 is a delivery passage 13 which contains a nonreturn valve 15 and the end of which merges into a radially extending distributor hole 17. In the radial plane in which this distributor hole 17 is arranged, the guide part 5 has injection lines 19 which lead from the cylinder bore 2 to the individual injection locations of the internal combustion engine. The injection lines 19 are arranged in a number corresponding to the number of injection locations to be supplied and in a manner distributed around the circumference of the guiding part 5 at an appropriate distance from one another.

A supply hole 21 leading off radially from the delivery passage 13 is furthermore provided in the rotor part 1 between the nonreturn valve 15 and the through-holes 11 and this supply hole 21 can be connected to a fuel feed line 23 in the guide part 5, which, for its part, is connected to a fuel feed line (not shown), preferably controlled by a solenoid valve and having a feed pump, from a fuel tank which forms a low-pressure space.

Figure 2:
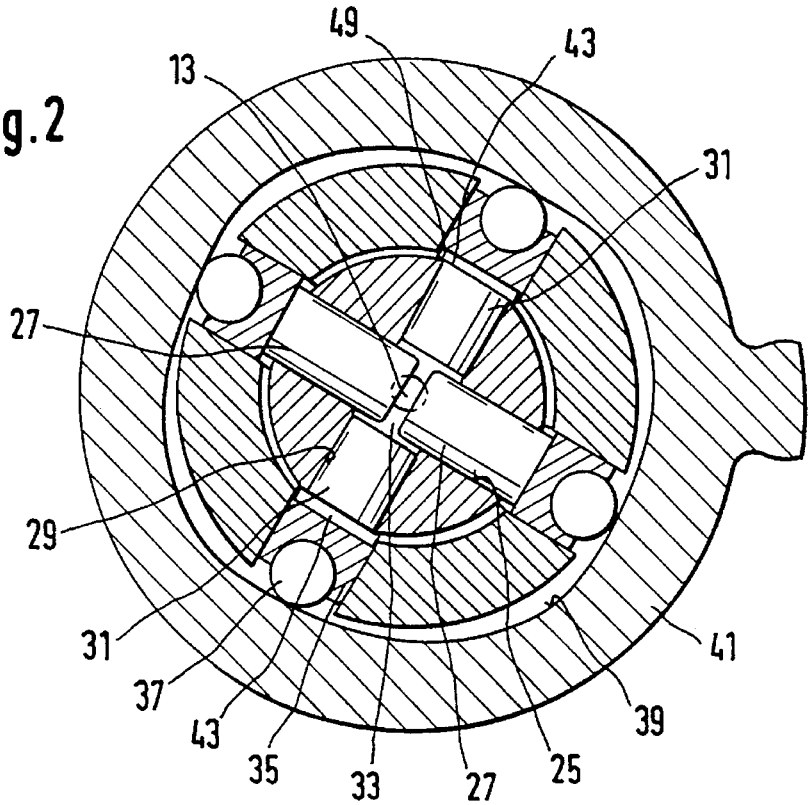
FIG. 2 shows a first exemplary embodiment of the retention of the pump plungers by means of a collar, in a section of FIG. 1.
Figure 3:
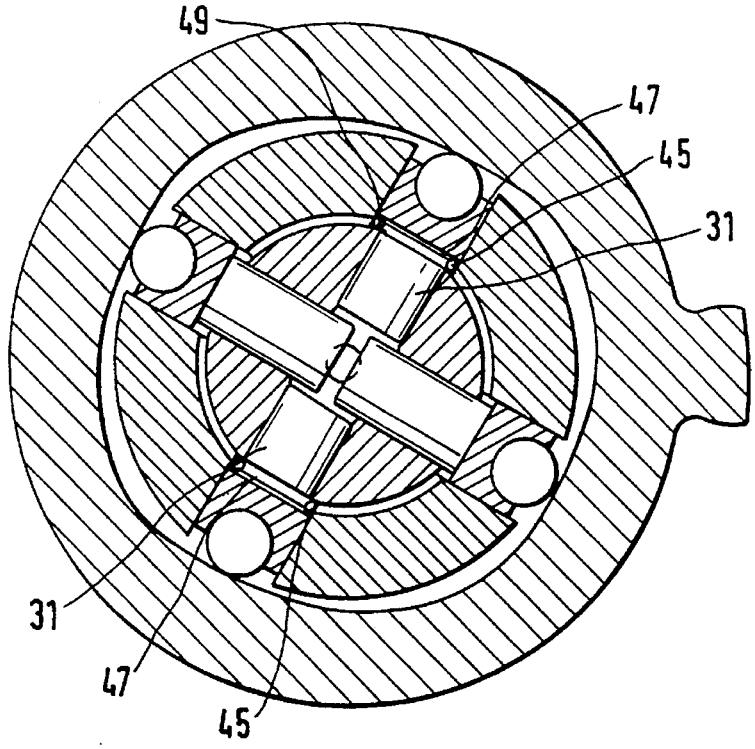
FIG. 3 shows a second exemplary embodiment of the retention of the pump plungers by means of a retaining ring in an illustration analogous to that in FIG. 2.

The radial through-holes 11 in that part 7 of the rotor part 1 which has a larger diameter are designed as cylinder bores in each of which, as can also be seen from FIGS. 2 and 3, two mutually opposite and oppositely acting pump plungers are arranged. Here, a first cylinder bore 25 accommodates a first pump-plunger pair 27 with a large axial extent, the pump plungers 27 of which are given a length such that, during the radially inward delivery-stroke movement, they project into the region of a second cylinder bore 29 which intersects the first. Guided in this second cylinder bore 29 is a second, shorter pump-plunger pair 31, the pump plungers 31 of which are dimensioned in such a way that they do not project into the region of the first cylinder bore 25, even in the maximum delivery-stroke position. With their radially inward-facing ends, the pump plungers 27, 31 delimit a common pump working space 33 in the cylinder bores 25, 29, this pump working space being connectable via the delivery passage 13 to the injection lines 19 and the fuel feed line 23.

With their radially outward-facing ends, the pump plungers 27, 31 each rest against a roller tappet 35, the roller 37 of which runs on a cam track 39 of a cam ring 41 lying in the radial plane and guided in the pump casing 3. During the operation of the distributor-type fuel injection pump, the pump plungers 27, 31 are held in contact with the roller tappets 35 by the centrifugal force towards the outside. When the pump is stationary, the pump plungers 27, 31 can slide by themselves in the cylinder bores 25, 29 depending on the position of the rotor part 1. In order to reliably prevent a short pump plunger 31 from slipping in between the long pump plungers 27 into the region of the first cylinder bore 25, the short pump plungers 31 have on their ends projecting radially out of the second cylinder bore 29 a stop which interacts with the respective axial end wall 49 of the cylinder bore 29. In the first exemplary embodiment shown in FIG. 2, this stop is designed as a collar 43 formed by a cross-sectional enlargement.

In the second exemplary embodiment, depicted in FIG. 3, the axial end stop on the short pump plungers 31 is formed by a retaining ring 45 which is guided in an annular groove 47 at that end of the short pump plungers 31 which projects out of the cylinder bore 29, and this retaining ring likewise interacts with the axial end wall 49 of the cylinder bore 29.

This travel limitation of the maximum penetration depths, which are at least equal to the maximum cam lift or delivery stroke, allow the delivery stroke to be made of a length such that the working-space ends of the long pump plungers 27 can emerge from the second cylinder bore 29 without the risk that the short pump plungers 31 will slip unintentionally in between the long plungers.

The distributor-type fuel injection pump according to the invention operates in the following manner.

When the pump is stationary, the pump plungers 27, 31 are, with the pump working space 33 unpressurized, in indeterminate positions, which can also be the respective maximum stroke positions, depending on the position of the rotor part 1. As operation of the distributor-type fuel injection pump begins, a rotary motion is imparted to the rotor part 1 by the drive shaft 9, and as a result, the pump plungers 27, 31 are moved into contact with the roller tappets 35 by the centrifugal force, the roller tappets, for their part, running along the cam track 39 and thus imparting a reciprocating motion to the pump plungers 27, 31 in the cylinder bores 25, 29.

The fuel compressed in the pump working space 33 during the delivery stroke of the pump plungers 27, 31 is guided via the delivery passage 13 and the nonreturn valve 15 to the distributor hole 17, from where it is fed to the respective injection locations as the individual injection lines 19 are passed over. The feedline 23 from the low-pressure space is here closed at the time of high-pressure delivery, it being possible for this closure to be effected by means of a solenoid valve arranged in the feedline 23 or the emergence of the supply hole 21 from its overlap with the feed hole 23.

The end of high-pressure delivery is controlled by the renewed opening of the connection between the supply line 21 and the fuel feed line 23. The residual fuel under high pressure initially flows back into the low-pressure space before renewed filling of the pump working space 33 takes place during the suction stroke of the pump plungers 27, 31, the nonreturn valve 15 ensuring a constant static pressure in the distributor hole 17 and the injection lines 19.

It is thus possible, without great complexity of construction, with the distributor-type fuel injection pump according to the invention to increase the size of the delivery stroke of the pump plungers depending on the respective requirements to an extent such that the axially longer pump-plunger pair emerges from the cylinder bore guiding the shorter pump-plunger pair.

The foregoing relates to preferred exemplary embodiments of the invention, it being understood that other variants and embodiments thereof are possible within the spirit and scope of the invention, the latter being defined by the appended claims.

What is claimed is:

1. A distributor-type fuel injection pump for internal combustion engines comprising a housing, a cam drive, said cam drive is driven in rotation by a drive shaft (9) and during the rotary motion of said drive shaft a reciprocating motion is imparted to a pump plunger in a cylinder bore arranged radially relative to the drive shaft by means of a roller tappet (35) which runs along a cam track (39), in a rotor part (1), at least two intersecting cylinder bores being provided in the rotor part in a plane radial relative to the drive shaft, in each of said cylinder bores two mutually opposite pump plungers are arranged which delimit a common pump working space (33) alternately connectable to a low-pressure space (23) and an injection line (19) and which are moved radially inwards during the delivery stroke and the axial length of said pump plungers is designed such that, during the delivery stroke movement, a first, longer pump-plunger pair (27) guided in a first cylinder bore (25) in each case includes one end that enters a second intersecting cylinder bore (29) which guides a shorter second pump-plunger pair (31) and the shorter pump plungers (31), guided in said cylinder bore (29) do not intersect the first cylinder bore (25) in their maximum delivery-stroke position, wherein the pump plungers (31) of the second, shorter pump-plunger pair each have a stop (45) at an end that protects out of the second cylinder bore (29), the said stop limiting said second pump plungers to a maximum depth of penetration into the cylinder bore (29) in the direction of the pump working space (33), and the shorter pump plungers (31) each come to rest by use of their stop on an axial end wall (49) of the cylinder bore (29) which guides and stops said shorter pump plungers before a pump working-space end enters the region of the cylinder bore (25).

2. The distributor-type fuel injection pump as claimed in claim 1, wherein the stop at the end of the short pump plungers (31) which projects out of the second cylinder bore (29) is designed as a collar (43) which is formed by an increasing cross section and which interacts with the axial end wall (49) of the second cylinder bore.

3. The distributor-type fuel injection pump as claimed in claim 1, wherein the stop at the end of the short pump plungers (31) which projects out of the second cylinder bore (29) is formed by a retaining ring (45) which is guided in an annular groove (47) in the short pump plunger (31) and interacts with the axial end wall (49) of the second cylinder bore.

* * * * *